US006058565A

United States Patent [19]

Jeong

[11] Patent Number: 6,058,565

[45] Date of Patent: May 9, 2000

[54] LOWER HINGE ENGAGING STRUCTURE FOR REFRIGERATOR

[75] Inventor: Gwan Sik Jeong, Changwon, Rep. of Korea

[73] Assignee: LG Electronics Inc., Rep. of Korea

[21] Appl. No.: 09/007,580

[22] Filed: Jan. 15, 1998

[30] Foreign Application Priority Data

Oct. 14, 1997 [KR] Rep. of Korea ..... 97-28419

[51] Int. Cl.[7] ..... E05D 5/00

[52] U.S. Cl. ..... 16/382; 248/282.1; 312/326; 16/270

[58] Field of Search ..... 16/382, 270; 312/326, 312/405; 49/381, 396; 248/282.1

[56] References Cited

U.S. PATENT DOCUMENTS 5,088,154 2/1992 Ishikawa ..... 16/382

5,150,500 9/1992 Bisbing ..... 16/382

*Primary Examiner*—Chuck Y. Mah
*Assistant Examiner*—Donald M. Gurley
*Attorney, Agent, or Firm*—Ostrolenk, Faber, Gerb & Soffen, LLP

[57] ABSTRACT

A lower hinge engaging structure for a refrigerator which is capable of providing a substantial door supporting force which is proportional to the weight of the refrigerator door and preventing a deformation of the refrigerator door. The structure includes a lower hinge inserted into a lower surface of a refrigerator door for supporting the weight of the refrigerator door, a hinge support member installed behind the lower hinge for supporting the lower hinge, and a hinge plate inserted between the hinge support member and the lower hinge for supporting the lower hinge toward the hinge support member by a predetermined force which is generated proportionally to the weight of the refrigerator door.

1 Claim, 4 Drawing Sheets

LOWER HINGE ENGAGING STRUCTURE FOR REFRIGERATOR

BACKGROUND OF THE INVENTION

1. Field of the Invention

The present invention relates to a lower hinge engaging structure for a refrigerator for rotatably supporting a refrigerator door, and in particular to an improved lower hinge engaging structure for a refrigerator which is capable of being separable without using a predetermined device for disassembling and assembling the same and providing a stable support force with respect to a refrigerator door, proportionally to the weight of a refrigerator door.

2. Description of the Background Art

Generally, a refrigerator door is rotatably engaged with a main body casing of a refrigerator, so that the refrigerator is opened or closed by the rotational operation of the refrigerator door.

The refrigerator door is engaged to the refrigerator main body casing by a support member which is installed in a lower portion of the refrigerator main body casing for supporting the refrigerator door.

As shown in FIG. 1, the conventional support member includes a lower hinge 4 inserted into a predetermined lower portion of the refrigerator door 2 for supporting the weight of the refrigerator door 2, a hinge support portion 7 fixed to an inner portion of the refrigerator main body casing 8 for supporting the lower hinge 4 and the refrigerator main body casing 8, and a plurality of fixing screws 6 for fixing the lower hinge 4 to the refrigerator main body casing 8.

The lower hinge 4 includes a body 4*a* having a 90° curved portion, and a hinge pin 4*b* upwardly protruded from the upper portion of the body 4*a* and inserted into a hinge hole 2*a* formed in the lower portion of the refrigerator door 2. A plurality of through holes (not shown) into which the fixing screws 6 are inserted are formed in a vertical portion of the body 4*a*.

The lower hinge 4 installed for supporting the weight of the refrigerator door 2 and the hinge support portion 7 installed for reinforcing the refrigerator casing 8 have an L-shaped portion, respectively. In each of the lower hinge 4 and the hinge support portion 7, a plurality of through holes into which the fixing screws 6 are inserted are formed.

In the thusly constituted refrigerator door supporting member, the hinge support portion 7 is fixed to the inner portion of the refrigerator casing 8, and the through holes formed in the vertical portion of the hinge support portion 7 and the through holes formed in the vertical portion of the lower hinge 4 are engaged using the fixing screws 6, and then the hinge pin is inserted into the hinge hole formed in the lower portion of the refrigerator door, so that the refrigerator door 2 is stably supported.

However, since the conventional refrigerator door support member is fixed to the refrigerator casing using a plurality of fixing screws, when disassembling or assembling the lower hinge, a predetermined device (tool) is inconveniently used for loosening or unloosening the fixing screws.

In addition, if the fixing screws are damaged due to the abrasion in the threaded portions of the same due to the repeated loosening or unloosening operation, it is impossible to stably support the refrigerator door. Therefore, the refrigerator door may be deformed, so that the power loss may be increased due to the gap formed between the refrigerator door and the refrigerator main body casing.

SUMMARY OF THE INVENTION

Accordingly, it is an object of the present invention to provide a lower hinge engaging structure for a refrigerator which overcomes the aforementioned problems encountered in the background art.

It is another object of the present invention to provide a lower hinge engaging structure for a refrigerator by which it is possible to assemble a refrigerator door to a refrigerator main body casing or to disassemble the same from the refrigerator main body casing without using a predetermined device (tool) for assembling or disassembling the refrigerator door and the refrigerator main body casing.

It is another object of the present invention to provide a lower hinge engaging structure for a refrigerator which is capable of providing a substantial door supporting force which is generated, proportionally to the weight of the refrigerator door and preventing a deformation of the refrigerator door.

To achieve the above objects, there is provided a lower hinge engaging structure for a refrigerator which includes a lower hinge inserted into a lower surface of a refrigerator door for supporting the weight of the refrigerator door, a hinge support means installed behind the lower hinge for supporting the lower hinge, and a hinge plate inserted between the hinge support means and the lower hinge for supporting the lower hinge toward the hinge support means by a predetermined force which is generated proportionally to the weight of the refrigerator door.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The lower hinge engaging structure for a refrigerator according to the present invention will now be explained with reference to the accompanying drawings.

Figure 1:
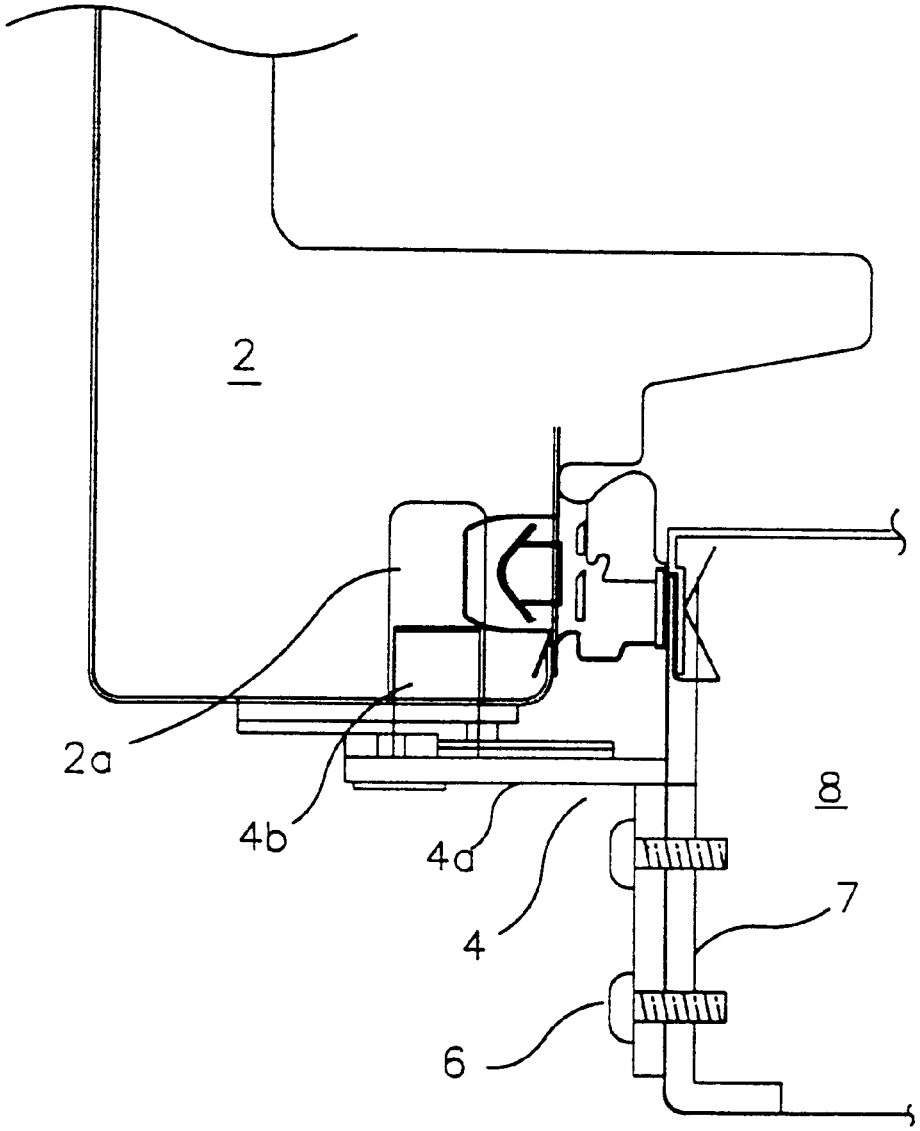
FIG. 1 CONVENTIONAL ART
FIG. 1 is a cross-sectional view illustrating a fixing structure for a conventional refrigerator door support member.
Figure 2:
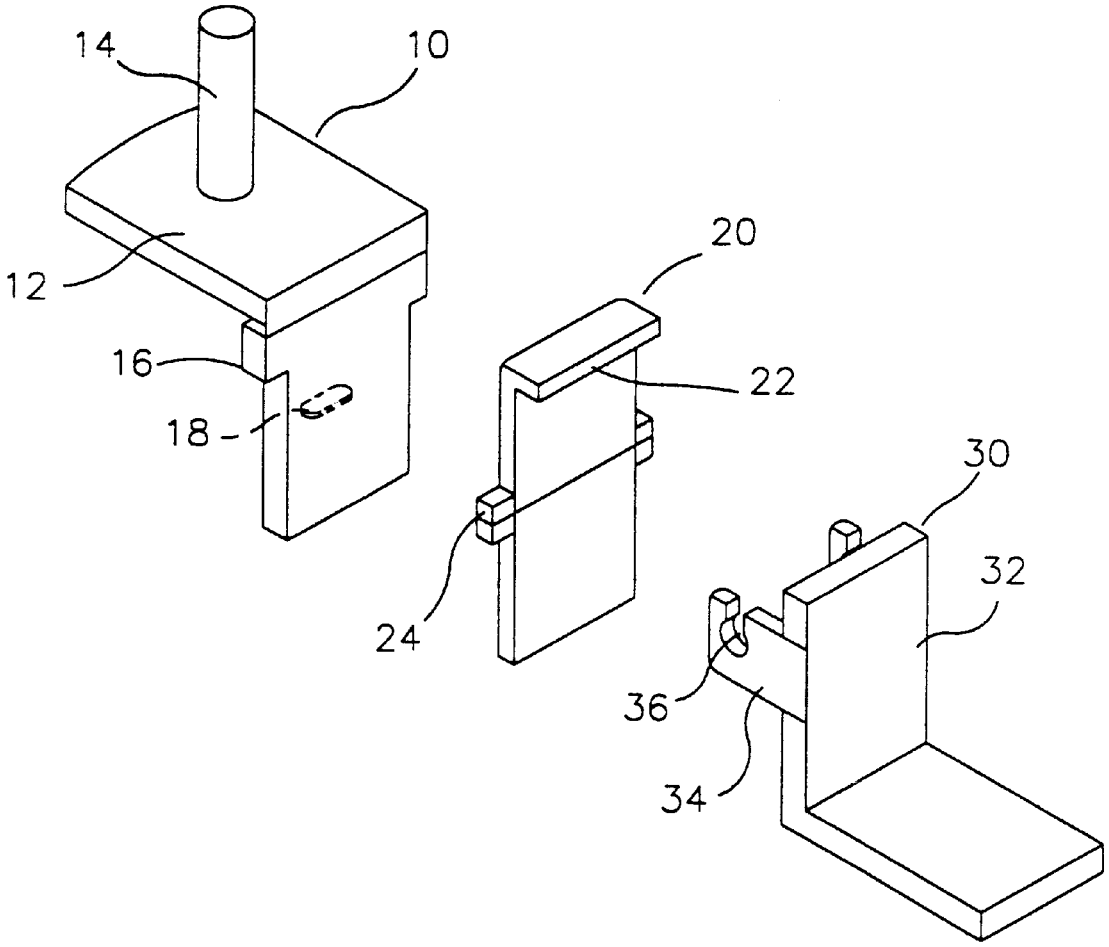
FIG. 2 is an exploded perspective view illustrating the construction of a refrigerator door support member according to the present invention.

First, as shown in FIG. 2, the lower hinge engaging structure according to the present invention includes a lower hinge 10 inserted into a lower portion of a refrigerator door 40 for supporting the weight of the refrigerator door 40, a hinge support member 30 for supporting the lower hinge 10, and a hinge plate 20 for supporting the lower hinge 10 to the hinge support member 30, wherein the supporting operation is performed proportionally to the weight of the refrigerator door 40.

The lower hinge 10 includes a body 12 having a horizontal portion and a vertical portion which is downwardly curved at a right angle from the horizontal portion, a hinge pin 14 upwardly protruded from a upper surface of the horizontal portion of the body 12 and inserted into a hinge hole 42 of the refrigerator door 40 for rotatably supporting the refrigerator door 40, a support shoulder 16 extended from both sides of an upper portion of the vertical portion of the body 12 and supported by the hinge support member 30, and a pressing protrusion 18 protruded toward the front portion of the lower center portion of the body 12 in the direction of the hinge plate for pressing the hinge plate 20.

The hinge support member 30 includes an L-shaped frame 32, a pair of support portions 34 extended from both sides of a vertical portion of the frame 32 in an opposite direction of the horizontal portion of the frame 32 for supporting the lower hinge 10, and a C-shaped support groove 36 formed in the upper portion of each of the support portion 34 and into which the hinge plate 20 is inserted.

The hinge plate 20 includes a curved end portion 22 which is horizontally curved toward the frame of the hinge support member and presses the lower hinge backwardly (toward the frame 32) by pressing the pressing a lower portion of the hinge plate 20 by protrusion 18 formed in the lower hinge 10, and a support protrusion 24 protruded from both sides of the upper portion of the vertical portion and rotatably inserted into the hinge support member 30.

The engaging structure of the lower hinge according to the present invention will now be explained with reference to the accompanying drawings.

Figure 3:
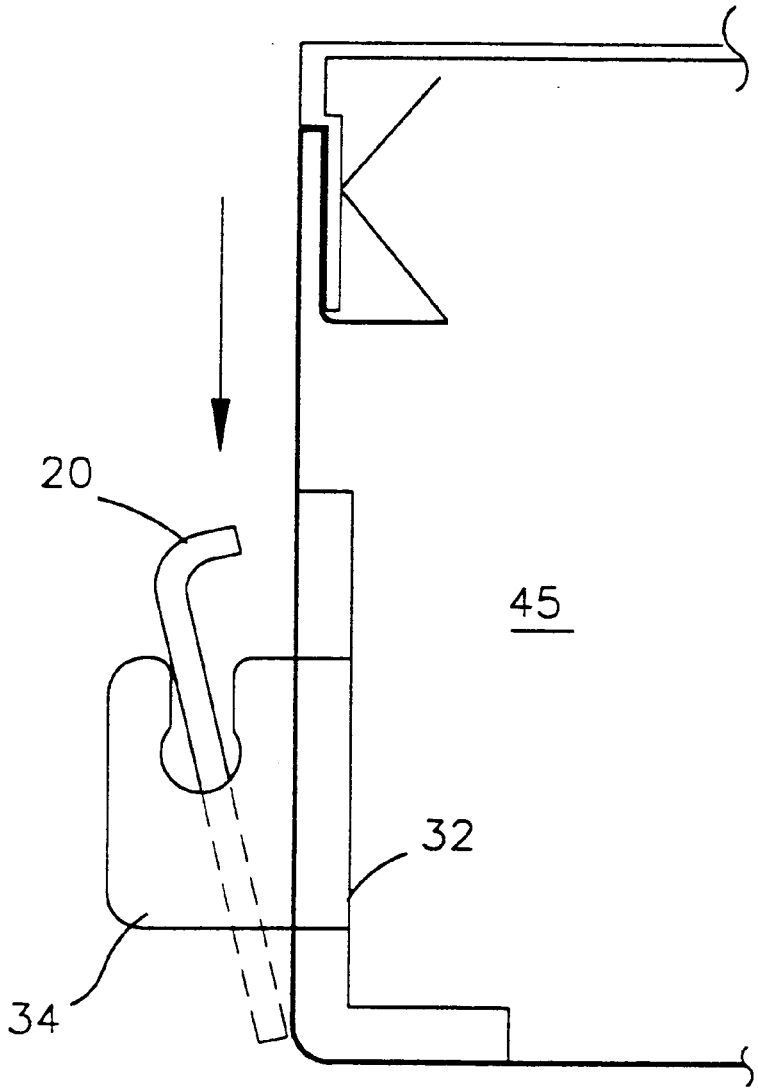
FIG. 3 is a cross-sectional view illustrating a state that a hinge plate is engaged to a hinge support member of a refrigerator door support member according to the present invention.
Figure 4:
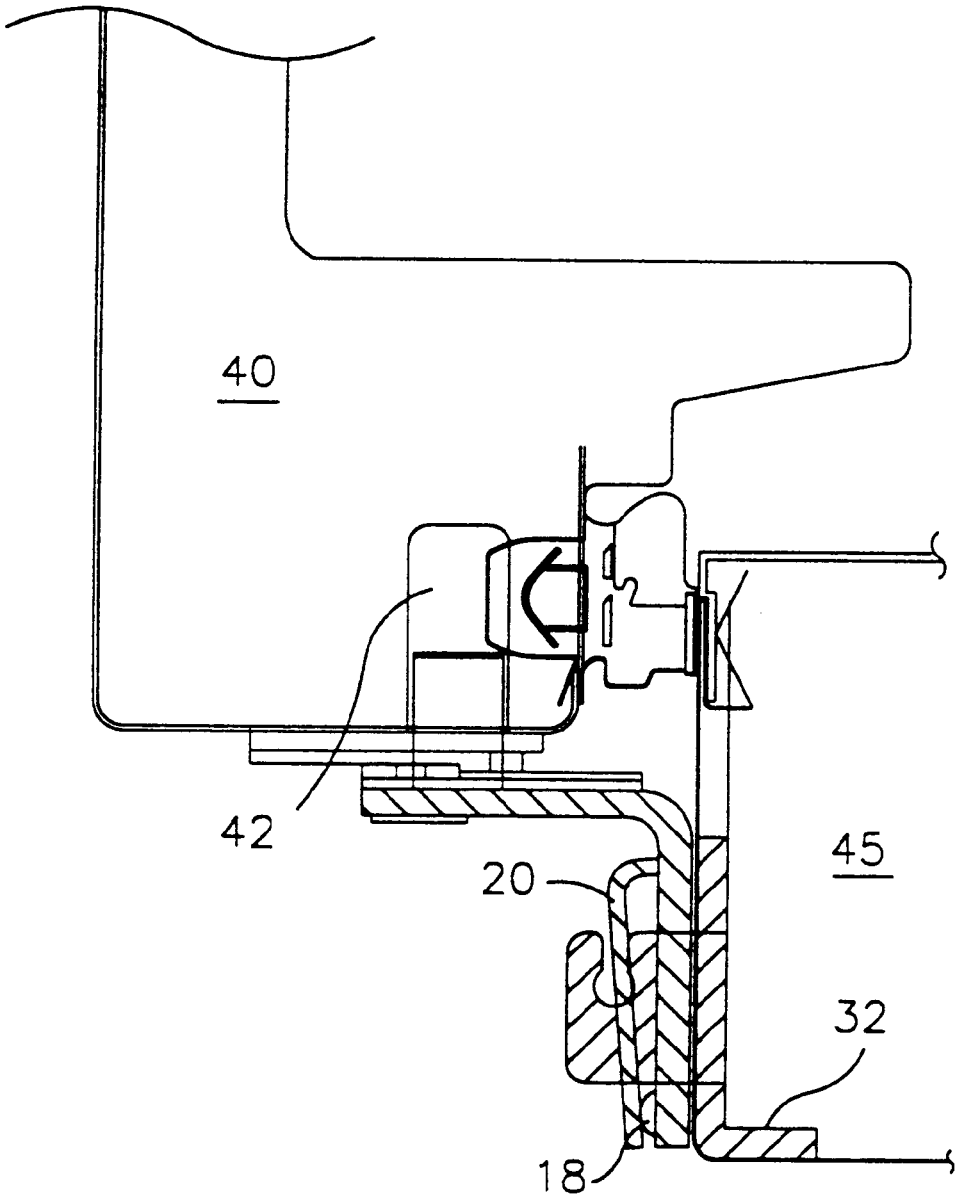
FIG. 4 is a cross-sectional view illustrating a fixing structure for a refrigerator door support member according to the present invention.

As shown in FIGS. 3 and 4, in the engaging structure of the lower hinge according to the present invention, the frame 32 of the hinge support member 30 is fixed to the front surface and the lower inner portion of the refrigerator casing 45, respectively.

At this time, a pair of the support portions 34 protruded from both sides of the upper portion of the frame 32 are forwardly protruded, so that the frame 32 is fixed to the refrigerator casing 45.

Next, the support protrusion 24 of the hinge plate 20 is inserted into the support groove 36 of the support portion 34 which is forwardly protruded.

The support shoulder 16 protruded from both sides of the vertical portion of the body 12 of the lower hinge 10 is placed on the upper surface of the support portion 34 of the hinge support member 30 and between the hinge support member 30 and the hinge plate 20, and then the vertical portion of the body 12 of the lower hinge 10 is downwardly inserted, thus finishing the engaging operation.

As shown in FIG. 3, the hinge plate 20 rotatably engaged to the support groove 36 of the frame 32 is installed so that the lower portion of the same contacts with the lower portion of the frame 32.

At this time, the hinge pin 14 of the lower hinge 10 is inserted into the hinge hole 42 of the refrigerator door 40, so that the lower hinge 10 receives the weight of the refrigerator door 40.

The lower hinge 10 is inserted in such a manner that the support shoulder 16 formed in the vertical portion of the body 12 is placed on the upper surface of the support portion 34 of the frame 32.

When the lower hinge 10 is inserted between the frame 32 of the hinge support member 30 and the hinge plate 20, the weight of the refrigerator door 40 is transferred to the frame 32 of the hinge support member 30 through the support shoulder 16 formed in the vertical portion of the body 12 of the lower hinge 10.

Since the frame 32 is stably fixed to the front surface and the lower surface of the refrigerator casing 45, the weight of the refrigerator door 40 is effectively supported.

In addition, since the pressing protrusion 18 is protruded from an inner surface of the vertical portion of the body 12 of the lower hinge 10, the lower hinge 10 is inserted between the hinge support member 30 and the hinge plate 20 and forwardly pushes a lower portion of the vertical portion of the hinge plate 20.

In the thusly engaged state, the hinge pin 14 upwardly formed in the horizontal center portion of the lower hinge 10 is inserted into the hinge hole 42 formed in the lower portion of the refrigerator door 40, thus rotatably supporting the refrigerator door 40.

In the lower hinge engaging structure for supporting the refrigerator door 40 according to the present invention, the weight of the refrigerator door 40 is supported by the support portion 34 of the hinge support member 30. In addition, as the weight of the refrigerator door 40 is increased, when the force which is applied downwardly from the lower hinge 10 is increased, the pressing protrusion 18 of the lower hinge 10 presses the lower portion of the hinge plate 20.

Since the curved end portion 22 of the hinge plate 20 more strongly presses the lower hinge 10 with respect to the refrigerator casing 45, it is possible to obtain a predetermined force, proportionally to the weight of the refrigerator door 40.

As described above, in the lower hinge engaging structure for a refrigerator according to the present invention, it is possible to effectively support the weight of the refrigerator door by simply inserting without using a predetermined engaging device and tool.

In addition, in the lower hinge engaging structure for a refrigerator according to the present invention, the more the weight of the refrigerator door is increased, the more the lower hinge presses the refrigerating casing, so that it is possible to more stably support the refrigerator door, proportionally to the weight of the refrigerator.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A lower hinge engaging structure for a refrigerator, comprising:

a hinge support including an L-shaped frame, a pair of support portions protruding from both sides of a vertical portion of the frame in an opposite direction of a horizontal portion, and a support groove which is C-shaped in each upper portion of the support portion, and fixed to a front surface and a lower inner portion of a refrigerator casing;

a hinge plate including a vertical portion and a curved end portion which is horizontally curved toward the hinge support and a support protrusion protruding from both sides of an upper portion of the vertical portion and rotatably engaged with respect to the support groove of the hinge support; and a lower hinge including a body having a horizontal portion and a vertical portion which is downwardly curved at a right angle from the horizontal portion and inserted between the hinge support and the hinge plate, a hinge pin upwardly protruding from a center of the horizontal portion of the body for being inserted into a hinge hole of a refrigerator door and rotatably supporting the refrigerator door, a support shoulder protruding from both sides of an upper portion of the vertical portion for being placed on the support portions of the hinge support, and a pressing protrusion protruding on an inner surface of the vertical portion of the body for pressing a lower portion of the vertical portion of the hinge plate.

* * * * *